United States Patent [19]

Gakhar et al.

[11] Patent Number: 5,027,984

[45] Date of Patent: Jul. 2, 1991

[54] CAULKING GUN ATTACHMENT FOR USE WITH A HIGH RPM POWER DRIVER AND CAPABLE OF BEING DRIVEN EITHER DIRECTLY AT FULL SPEED OR INDIRECTLY AT A LOWER SPEED VIA A GEAR REDUCER

[75] Inventors: Ved P. Gakhar; Wilfred M. McCord; David S. Hubbard, all of Louisville, Ky.

[73] Assignee: Vermont American Corporation, Louisville, Ky.

[21] Appl. No.: 405,954

[22] Filed: Sep. 12, 1989

[51] Int. Cl.[5] ..... B67D 5/46

[52] U.S. Cl. ..... 222/326; 222/333; 222/390

[58] Field of Search ..... 222/326, 327, 333, 390; 234/289; 403/373, 287

[56] References Cited

U.S. PATENT DOCUMENTS

| | | | |
|---|---|---|---|
| D. 289,881 | 5/1987 | Krumm . | |
| D. 290,681 | 7/1987 | Pudwill . | |
| 3,635,378 | 1/1972 | DeHart | 222/333 |
| 3,861,567 | 1/1975 | Davis . | |
| 3,985,273 | 10/1976 | Davis . | |
| 3,997,084 | 12/1976 | Davis . | |
| 4,024,994 | 5/1977 | Davis . | |
| 4,114,781 | 9/1978 | Doyel . | |
| 4,171,072 | 10/1979 | Davis . | |
| 4,249,677 | 2/1981 | Davis . | |
| 4,260,076 | 4/1981 | Bergman . | |
| 4,264,021 | 4/1981 | Davis . | |
| 4,273,269 | 6/1981 | Davis . | |
| 4,306,671 | 12/1981 | Fisher . | |
| 4,322,022 | 3/1982 | Bergman . | |
| 4,335,834 | 6/1982 | Zepkin . | |
| 4,376,498 | 3/1983 | Davis . | |
| 4,440,324 | 4/1984 | Lebecque . | |
| 4,615,469 | 10/1986 | Kishi et al. . | |
| 4,653,675 | 3/1987 | Ratzky . | |
| 4,706,853 | 11/1987 | Stonesifer et al. . | |

OTHER PUBLICATIONS

Uni-Caulk 1000 Brochure Published by Nirad Corp. circa 1985-1986.

*Primary Examiner*—Michael S. Huppert
*Assistant Examiner*—Kenneth R. DeRosa
*Attorney, Agent, or Firm*—Middleton & Reutlinger, P.S.C.

[57] ABSTRACT

A caulking gun holder/driver is adapted to be driven by a cordless screwdriver or other power driver and includes two different shafts to which the driver can be attached. The holder/driver has a receptacle for receiving a tube of caulk, a threaded pusher rod with a pusher plate at its distal end to drive the caulk out of the receptacle, and flats at the proximal end to receive a power driver for "high speed" advance or retraction of the threaded driving rod, and a main drive shaft adaptable to receive the same power driving unit to rotate the threaded rod in a "slow speed" for better caulking application. In the dispensing mode, the threaded rod is connected via gear-reducer to the second drive shaft which permits only slow advancement of the threaded rod for better control of the flow of caulking compound out of the caulking tube, and prevention of "dribble" when power is turned off to the driving unit.

8 Claims, 4 Drawing Sheets

CAULKING GUN ATTACHMENT FOR USE WITH A HIGH RPM POWER DRIVER AND CAPABLE OF BEING DRIVEN EITHER DIRECTLY AT FULL SPEED OR INDIRECTLY AT A LOWER SPEED VIA A GEAR REDUCER

BACKGROUND OF THE INVENTION

The present invention relates to caulking guns, and, in particular, to caulking guns that can be powered by a cordless electric driver.

There are lots of electric caulking guns known in the art, and many of them are very sophisticated, with many features such as the ability to retract the pusher as the trigger is released in order to quickly stop the flow of caulk. However, there is not a good, reliable and inexpensive power caulking gun for the do-it-yourself market.

Many people do their own home repairs and construction projects, requiring the use of a caulking gun for applying sealants, adhesives, and so forth. Most do-it-yourselfers use a manual caulking gun for that purpose. However, for people with large amounts of caulking work or for those with arthritis or other physical problems, it is difficult to use a manual caulking gun.

A standard electric caulking gun with its own dedicated electric motor is too expensive for most do-it-yourselfers.

Also, many electric caulking guns have a pusher which rotates and tends to cause the tube of caulk to rotate, which creates a problem. Various gadgets have been added to caulking guns to eliminate this problem, generally increasing the complexity and cost of the device.

SUMMARY OF THE INVENTION

The present invention provides the do-it-yourselfer with a simple, reliable, and inexpensive way to dispense caulk with the help of electric power.

The present invention provides a caulking gun designed to be driven by a reversible cordless electric screwdriver, a reversible cordless electric drill, or other powered drivers.

The present invention provides a separate drive attachment for rapidly moving the pusher into or out of the tube of caulk.

The present invention also provides a pusher rod which, when it is driving the caulk, does not rotate and therefore does not cause the problems found in other caulking guns, which cause the tube of caulk to rotate.

In addition, the present invention provides a means for solidly securing the driver to the caulking gun without damaging the driver so the caulking gun can be used with only one hand.

DESCRIPTION OF THE PREFERRED EMBODIMENT

Figure 1:
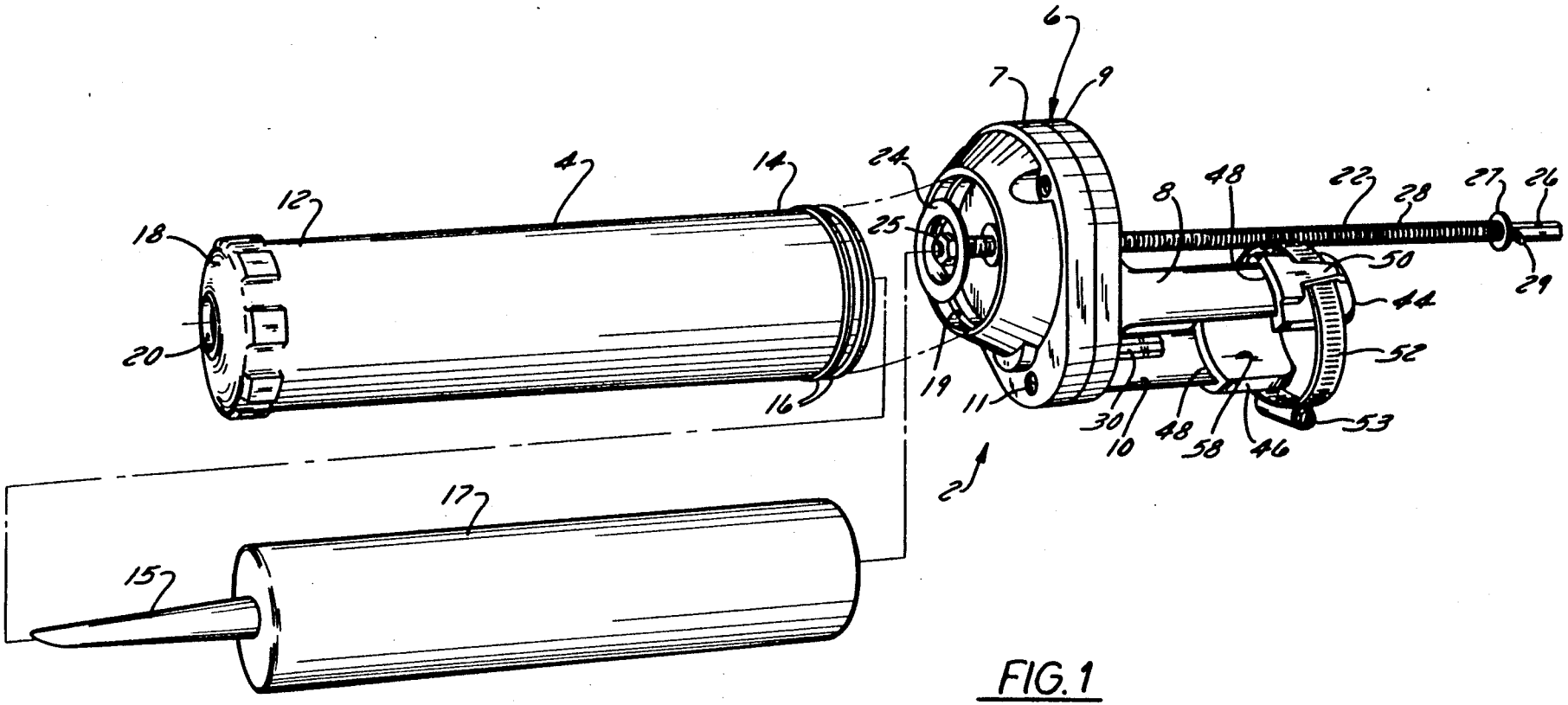
FIG. 1 is a perspective view of the caulking gun of the present invention, with the caulk receptacle removed to show the pusher, and showing an example of a tube of caulk that could be used with the invention.
Figure 2:
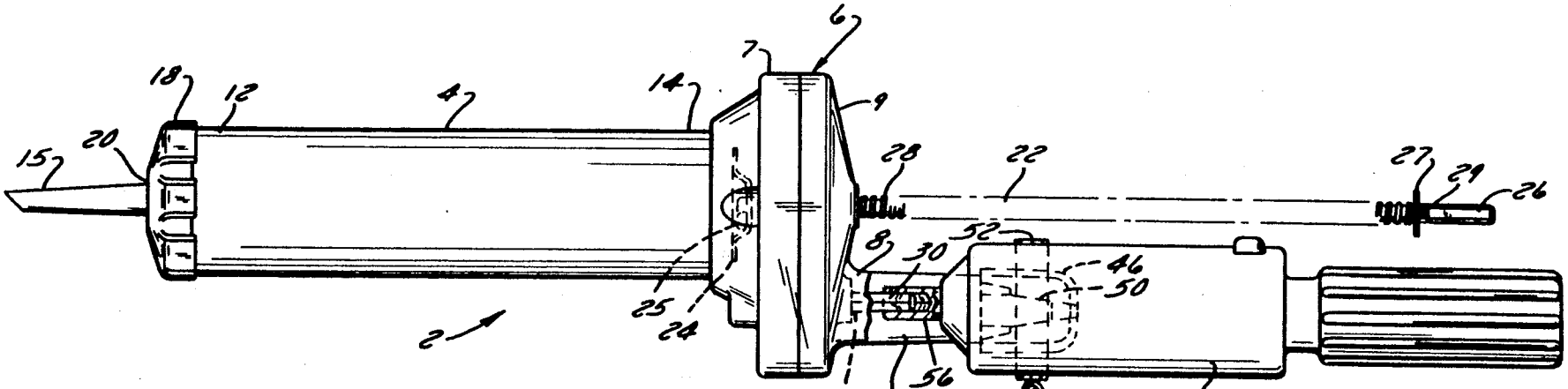
FIG. 2 is a front side view of the caulking gun of FIG. 1 with the tube of caulk inserted in the receptacle, the receptacle attached to the housing, and a portable electric screwdriver attached to the caulking gun for driving the gun.
Figure 3:
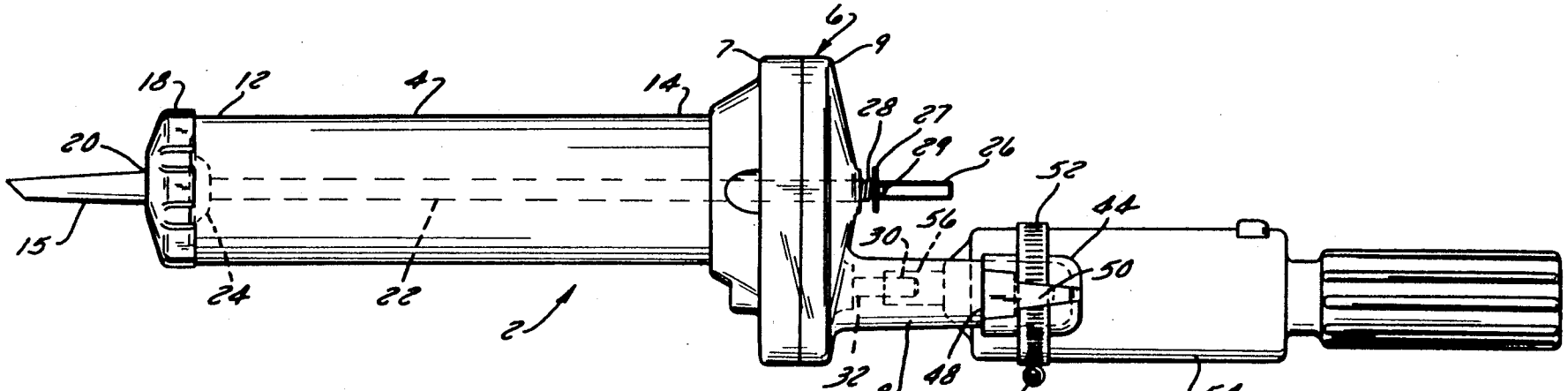
FIG. 3 is the same view as FIG. 2 but with the pusher rod in the forward position, after emptying the tube of caulk.
Figure 4:
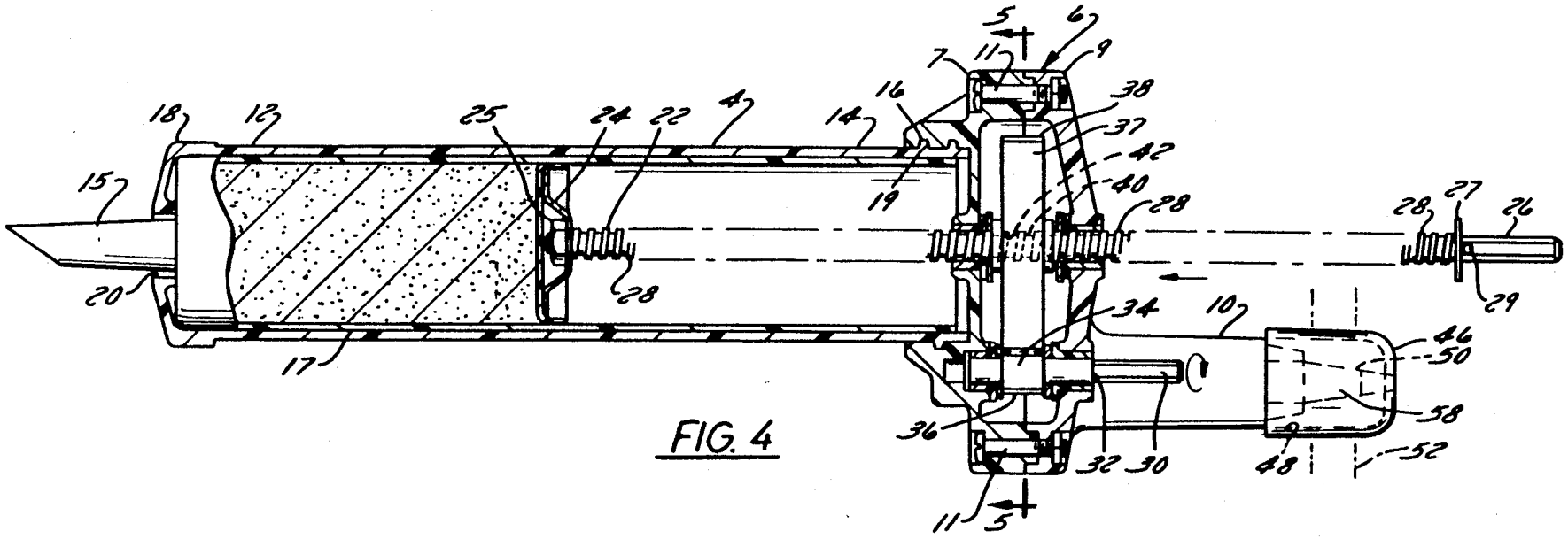
FIG. 4 is the same view as FIGS. 2 and 3 except that it is partially in section and the pusher is midway into the tube of caulk.
Figure 6:
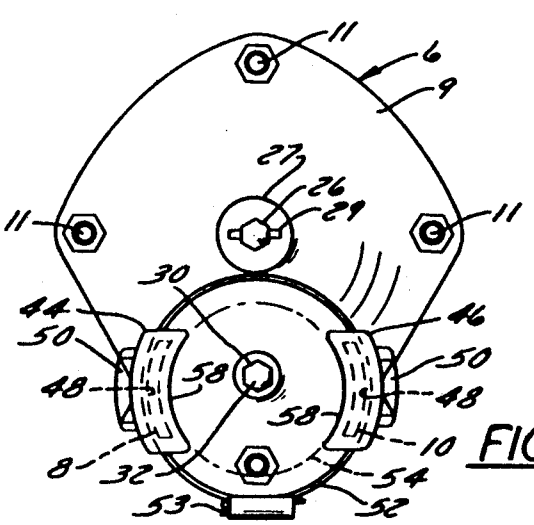
FIG. 6 is a right end view of the device shown in FIG. 1.

The caulking gun 2 of the present invention includes a cylindrical receptacle 4 for receiving the tube of caulk, a housing 6, which houses the drive mechanism, and two arms 8, 10, which retain the electric screwdriver or other power driver.

The housing 6 is made in two pieces 7, 9. The front piece 7 and back piece 9 are held together by means of nuts and bolts 11. The back piece 9 defines hexagonal recesses for receiving the nuts.

The forward end 12 of the cylindrical receptacle 4 has an integrally-molded end cap 18. The center of the end cap 18 defines an opening 20 through which the tip 15 of the tube of caulk 17 extends.

The back end 14 of the receptacle 4 has threads 16 in its outer surface which are received by internal threads 19 in the front piece 7 of the housing 6.

A pusher rod 22 extends through the housing 6. At its forward end, the pusher rod 22 has a pusher plate 24, which is flat and round and sized to fit inside the tube of caulk. The pusher plate 24 is coaxial with the pusher rod 22.

The forward end of the pusher rod 22 has a reduced diameter and is threaded. The pusher plate 24 is installed by inserting the forward end of the pusher rod 22 through the central opening in the pusher plate 24, and a nut 25 is threaded onto the pusher rod 22, clamping the pusher plate 24 between the nut 25 and the larger diameter portion of the pusher rod 22. While this is the design used in our prototypes, it is thought that, for production purposes, it will be preferable for the front end of the pusher rod to be machined down to a square section. The pusher plate would have a corresponding central squared opening which would fit over the end of the pusher rod, and the forward end of the pusher rod 22 would then be flared, clamping the pusher plate 24 between the flared forward end and the larger diameter portion of the pusher rod 22. Other known attachment means, such as welding, could be used.

At its rear end 26, the pusher rod 22 defines flats—preferably forming a standard hexagonal end which fits the mandrel of an electric screwdriver or an electric drill. In between the pusher plate 24 and the hexagonal end 26, the pusher rod is cylindrical in shape and defines threads 28 in its outer surface. Between the threaded portion 28 of the pusher rod 22 and the flats 26 is a stop 27 held in place by a pin 29 which extends through the pusher rod 22.

Another hexagonal end 30 also projects out of the back end of the housing 6. This is the end 30 of the main drive shaft 32, which extends into the housing 6 and is fixed to a small gear 34 having teeth 36 in its outer surface. The drive shaft 32 is coaxial with the small gear 34. The drive shaft 32 and small gear 34 are formed as one piece.

Figure 5:
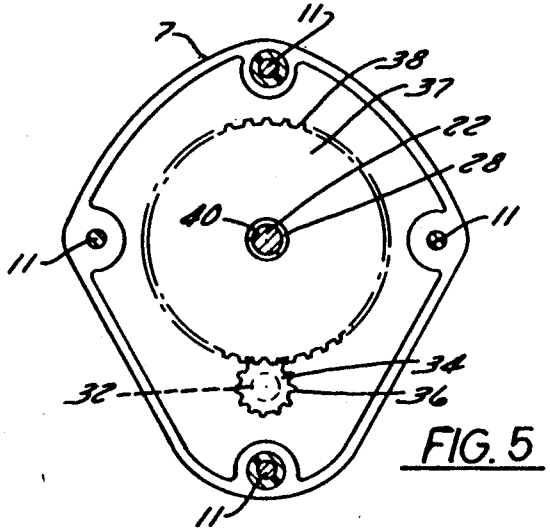
FIG. 5 is a view taken along the section 5-5 of FIG. 4.

The small gear 34 mates with a large gear 37, which has pinion-like teeth 38 extending completely around its outer surface. FIG. 5 shows some of the teeth and then is drawn in a schematic form, implying that the teeth continue around the entire circumference. The large gear 37 has a central opening 40 which defines internal threads 42, which receive the external threads 28 on the pusher rod 22. In the preferred embodiment, the gear ratio between the large gear 37 and the small gear is about 5:1, so the small gear 34 makes about five revolutions for every one revolution of the large gear 37. This is particularly suited to the drive speed of an electric screwdriver. Electric drills operate at much higher speeds, so a higher gear ratio would be desirable if the caulking gun is intended to be used with an electric drill.

Driving the lower drive shaft 32 with the electric screwdriver will drive the small gear 34, which causes the large gear 37 to rotate. If there is not much friction in the system, such as if the pusher plate 24 is not pushing against the plunger in a tube of caulk, the pusher rod 22 may rotate along with the large gear 37, preventing the pusher rod 22 from moving forward or backward. If that occurs, the operator need only put a thumb on the pusher shaft 22 to prevent it from rotating, and then the large gear 37 will rotate relative to the pusher shaft, causing the pusher shaft 22 to move forward or backward, depending on the direction of rotation. Once the pusher plate 24 contacts the plunger in the caulking tube 17, the friction between the pusher plate 24 and the plunger will prevent the pusher rod 22 from rotating with the large gear 37, so the large gear 37 rotates relative to the pusher rod 22, causing the pusher rod 22 to be driven forward. The tube of caulk 17 will always be dispensed by driving the lower shaft 32, which causes the large gear 37 to rotate. In that mode, the pusher rod can only be driven if it does not rotate with the gear 37. Therefore, this driving arrangement eliminates the problems of prior art devices in which a rotating pusher rod causes the tube of caulk to rotate.

Figure 7:
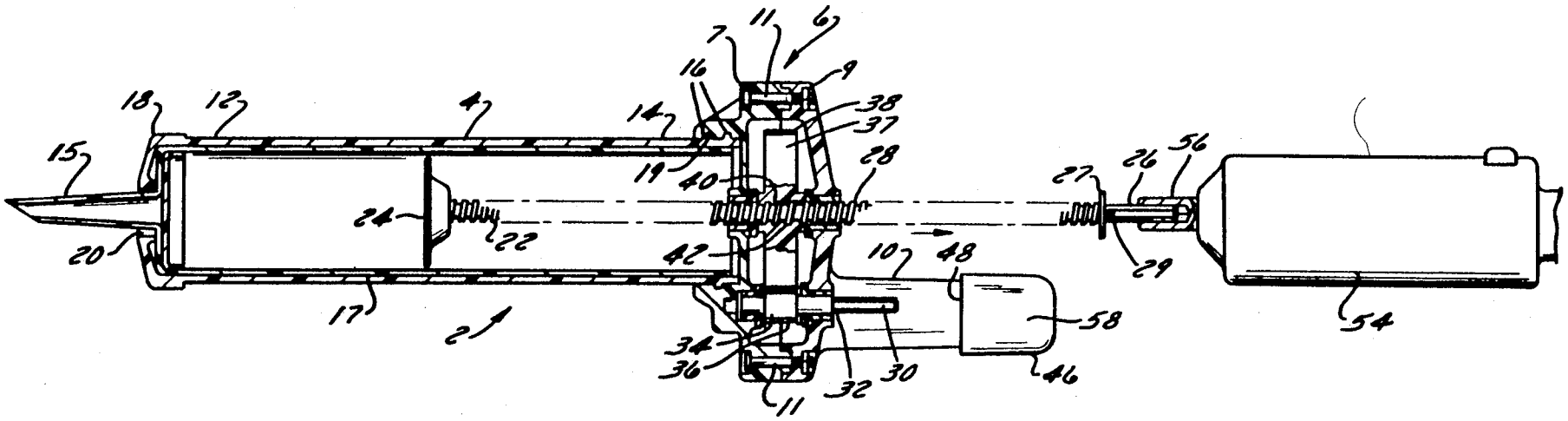
FIG. 7 is a front side sectional view of the caulking gun, partially in phantom, showing the portable electric screwdriver attached to the pusher rod for rapid retraction of the pusher rod.

If the operator wishes to move the pusher rod 22 forward rapidly, such as to reach the plunger of a partially-empty caulking tube to begin caulking, or to quickly retract the pusher 24 when one tube is emptied and another is to be inserted, the electric drill or other power driver can be connected directly to the hex end 26 of the pusher rod 22, as shown in FIG. 7, to bypass the gear reduction and drive the pusher rod 22 at the speed of the power driver. Again, if there is not sufficient friction, it may be necessary to put a thumb on the lower shaft 32 to prevent the large gear 37 from rotating with the pusher rod 22.

Two arms 8, 10 project rearward from the back piece 9 of the housing 6, away from the receptacle 4. The arms 8, 10 are integrally molded with the housing 6. Two tips 44, 46 are separately molded from a more compressible material than the body 6, and each tip 44, 46 defines a slot 48 which receives the end of its respective arm 8, 10 to hold the tips 44, 46 on the arms 8, 10. Each tip 44, 46 defines a bridge 50 under which a strap 52 passes. The strap 52 is a standard hose clamp which defines a closed loop and which is adjustable in length by rotating the screw 53.

In order to hold a portable electric screwdriver 54, drill or other driver in place so it does not move relative to the housing 6, the driver 54 is inserted into a driving position with the flats 30 of the main drive shaft 32 in the chuck 56 of the driver 54. The strap 52 is then tightened around the driver 54 by tightening the screw 53 so the compressible inner surfaces 58 at the ends of the arms 8, 10 press against the driver 54, holding it firmly in place without marring the surface of the driver 54. Because there is a tight fit between the tips 44, 46 and their respective arms 8, 10, the tips are retained on the caulking gun. Also, the bridges 50 retain the strap 52 on the caulking gun, so there are no loose parts which can get lost.

Thus, the present invention provides a very simple caulking gun which can be powered by a cordless electric driver. The caulking gun provides a means for rapidly moving the pusher plate 24 in and out in addition to means for the dispensing of caulk at a slower rate. The caulking gun 2 includes a driving arrangement which avoids the problem of rotation of the caulking tube 17 when it is being driven without requiring extra devices to be added to solve that problem. The caulking gun also includes means for attaching the driver to the caulking gun so the caulking gun can be used in one-hand operation. The result is a simple, reliable, inexpensive caulking gun for the do-it-yourselfer, who did not have access to such a device before.

It will be obvious to those skilled in the art that modifications may be made to the embodiment described above without departing from the scope of the present invention.

What is claimed is:

1. A caulking gun, comprising:

a receptacle for receiving a tube of caulk;

a pusher rod aligned with the longitudinal axis of the receptacle and having a pusher plate at the end directed toward the receptacle and defining flats on its outer surface at the other end;

a main drive shaft defining flats on its outer surface at one end; and gear reduction means between the main drive shaft and the pusher rod;

wherein the flats on the end of the drive shaft and the flats on the end of the pusher rod can be received in the same mandrel of a cordless electric driver, so that the pusher rod can be driven directly for high speed movement and can be driven at normal dispensing speed by driving the main drive shaft.

2. A caulking gun, comprising:

a receptacle for receiving a tube of caulk;

a pusher rod aligned with the longitudinal axis of the receptacle and having a pusher plate at one end directed toward the receptacle;

means for driving the pusher rod;

a housing attached to the receptacle;

at least two arms projecting from the housing away from the receptacle, each of said arms having an inner surface which is substantially more compersible than the housing, each of the arms defining a bridge for receiving a strap; and a strap passing under the bridges in the arms and including means for tightening the strap around the body of a portable driver, so as to compress the compressible inner surfaces against the portable driver to hold it in place.

3. A caulking gun, comprising:

a receptacle for receiving a tube of caulk;

a drive mechanism communicating with the receptacle for pushing the caulk out of its tube, including a pusher rod defining threads on its outer surface, the pusher rod being aligned with the longitudinal axis of the receptacle and having a pusher plate at the end directed toward the receptacle and defining flats on its outer surface at the other end wherein the pusher rod has a stop between its threads and its flats;

a large gear, defining a threaded central opening which receives the pusher rod, and defining teeth on its outer surface;

a small gear defining teeth on its outer surface which mesh with the teeth on the outer surface of the large gear;

a drive shaft fixed to the small gear and defining flats on its outer surface at one end which projects beyond the small gear and which can be received in the same mandrel as the flats of the pusher rod;

a housing surrounding the gears threadably attached to the receptacle; and means attached to the housing for receiving a power attachment comprising:

(a) at least two arms projecting rearward from the housing away from the receptacle, each of said arms having an inner surface which is substantially more compressible than the housing, each of the arms defining a bridge for receiving a strap;

(b) two tips made of a material that is substantially more compressible than the material of the housing, each of the tips defining a slot which receives its respective arm with a press fit, and each of the tips defining a bridge for receiving a strap; and (c) a strap passing under the bridges in the tips and including means for tightening the strap around the body of a portable driver so as to compress the compressible material of the tips against the portable driver to hold it in place without marring the portable driver, thereby permitting the caulking gun to be operated with only one hand.

4. A caulking gun, comprising:

a receptacle for receiving a tube of caulk;

a drive mechanism communicating with the receptacle for pushing the caulk out of its tube, including a pusher rod defining threads on its outer surface, the pusher rod being aligned with the longitudinal axis of the receptacle and having a pusher plate at the end directed toward the receptacle and defining flats on its outer surface at the other end;

a large gear, defining a threaded central opening which receives the threads of the pusher rod, and defining teeth on its outer surface;

a small gear defining teeth on its outer surface which mesh with the teeth on the outer surface of the large gear;

a drive shaft fixed to the small gear and defining flats on its outer surface at one end which projects beyond the small gear and which can be received in the same mandrel as the flats of the pusher rod;

a housing surrounding the gears attached to the receptacle; and means attached to the housing for receiving a power attachment comprising:

(a) at least two arms projecting rearward from the housing away from the receptacle, each of said arms having an inner surface which is substantially more compressible than the housing, each of the arms defining a bridge for receiving a strap;

(b) two tips made of a material that is substantially more compressible than the material of the housing, each of the tips defining a slot which receives its respective arm with a press fit, and each of the tips defining a bridge for receiving a strap; and (c) a strap passing under the bridges in the tips and including means for tightening the strap around the body of a portable driver so as to compress the compressible material of the tips against the portable driver to hold it in place without marring the portable driver, thereby permitting the caulking gun to be operated with only one hand.

5. A caulking gun, comprising:

a receptacle for receiving a tube of caulk;

a drive mechanism communicating with the receptacle for pushing the caulk out of its tube, including a pusher rod defining threads on its outer surface, the pusher rod being aligned with the longitudinal axis of the receptacle and having a pusher plate at the end directed toward the receptacle and defining flats on its outer surface at the other end;

a large gear, defining a threaded central opening which receives the threads of the pusher rod, and defining teeth on its outer surface;

a small gear defining teeth on its outer surface which mesh with the teeth on the outer surface of the large gear;

a drive shaft fixed to the small gear and defining flats on its outer surface at one end which projects beyond the small gear and which can be received in the same mandrel as the flats of the pusher rod;

a housing surrounding the gears; and means attached to the housing for receiving a power attachment.

6. A caulking gun as recited in claim 5, wherein the receptacle is threaded into the housing.

7. A caulking gun as recited in claim 6, wherein the pusher rod has a stop between its threads and its flats.

8. A caulking gun as recited in claim 5, wherein the means attached to the housing for receiving a power attachment comprises:

at least two arms projecting rearward from the housing;

two tips made of a material that is substantially more compressible than the material of the housing, each of the tips defining a slot which receives its respective arm with a press fit, and each of the tips defining a bridge for receiving a strap; and a strap passing under the bridges in the tips and including means for tightening the strap around the body of a portable driver so as to compress the compressible material of the tips against the portable driver to hold it in place without marring the portable driver, thereby permitting the caulking gun to be operated with only one hand.

* * * * *